US007651601B2

(12) United States Patent
Hwang et al.

(10) Patent No.: US 7,651,601 B2
(45) **Date of Patent: *Jan. 26, 2010**

(54) HEAT SPREADER WITH VAPOR CHAMBER DEFINED THEREIN AND METHOD OF MANUFACTURING THE SAME

(75) Inventors: Ching-Bai Hwang, Guangdong (CN); Jin-Gong Meng, Guangdong (CN)

(73) Assignees: Fu Zhun Precision Industry (Shen Zhen) Co., Ltd., Longhua Town, Bao'an District, Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 747 days.

This patent is subject to a terminal disclaimer.

(21) Appl. No.: 11/306,699

(22) Filed: Jan. 9, 2006

(65) Prior Publication Data

US 2007/0017814 A1 Jan. 25, 2007

(30) Foreign Application Priority Data

Jul. 22, 2005 (CN) ..... 2005 1 0036156

(51) Int. Cl.
*C25D 7/00* (2006.01)

(52) U.S. Cl. ..... 205/150; 205/70; 205/161

(58) Field of Classification Search ..... 205/70, 205/150, 161, 162, 163
See application file for complete search history.

(56) References Cited

U.S. PATENT DOCUMENTS 5,402,004 A * 3/1995 Ozmat ..... 257/717
5,642,776 A 7/1997 Meyer, IV et al.
6,679,318 B2 1/2004 Bakke

FOREIGN PATENT DOCUMENTS

EP 0692546 A1 * 1/1996

* cited by examiner

*Primary Examiner*—Nam X Nguyen
*Assistant Examiner*—Luan V Van
(74) *Attorney, Agent, or Firm*—Winston Hsu

(57) ABSTRACT

A heat spreader (10) and a method for manufacturing the heat spreader are disclosed. The heat spreader includes a metal casing (12) and a wick structure (16) lines an inner surface of the metal casing. The metal casing defines therein a chamber (14) and includes an evaporating section (126) and a condensing section (127). The wick structure is in the form of metal foam and occupies a portion of the chamber. In one embodiment, the wick structure has a pore size gradually increasing from the evaporating section towards the condensing section of the metal casing. The heat spreader is manufactured by electrodepositing a layer of metal coating (70) on an outer surface of a metal foam framework (20). The metal coating becomes the metal casing and the metal foam framework becomes the wick structure.

7 Claims, 11 Drawing Sheets

HEAT SPREADER WITH VAPOR CHAMBER DEFINED THEREIN AND METHOD OF MANUFACTURING THE SAME

FIELD OF THE INVENTION

The present invention relates to an apparatus for transfer or dissipation of heat from heat-generating components, and more particularly to a heat spreader having a vapor chamber defined therein and a method of manufacturing the heat spreader.

DESCRIPTION OF RELATED ART

It is well known that heat is generated during normal operations of a variety of electronic components, such as integrated circuit chips of computers. To ensure normal and safe operations, cooling devices such as heat sinks plus electric fans are often employed to dissipate the generated heat away from these electronic components.

As progress continues to be made in electronic industries, integrated circuit chips of computers are made to be more powerful while maintaining an unchanged size or even a smaller size. As a result, the amount of heat generated by these chips is commensurately increased. The heat sinks used to cool these chips are accordingly made larger in order to possess a higher heat removal capacity, which causes the heat sinks to have a much larger footprint than the chips. Generally speaking, a heat sink is most effective when there is a uniform heat flux applied over an entire base of the heat sink. When a heat sink with a large base is attached to an integrated circuit chip with a much smaller contact area, there is significant resistance to the flow of heat to the other portions of the heat sink base which are not in direct contact with the chip.

Currently, an advantageous mechanism for overcoming the resistance to heat flow in a heat sink base is to attach a heat spreader to the heat sink base or directly make the heat sink base as a heat spreader. In this situation, the heat spreader is configured to have a flat type configuration. Typically, the heat spreader includes a vacuum vessel defining therein a vapor chamber, and a working fluid contained in the chamber. In most cases, a wick structure is provided in the chamber, lining an inside wall of the vessel. As an integrated circuit chip is maintained in thermal contact with and transfers heat to the heat spreader, the working fluid contained in the chamber corresponding to the hot contacting location vaporizes into vapor. The vapor then runs quickly to be full of the chamber, and wherever the vapor comes into contact with a cooler wall surface of the vessel, it releases its latent heat of vaporization and thereafter turns into condensate. The condensate then returns back to the hot contacting location via a capillary force generated by the wick structure, to thereby remove the heat generated by the chip. In the chamber of the heat spreader, the thermal resistance associated with the vapor spreading is negligible, thus providing an effective means of spreading the heat from a concentrated source to a large heat transfer surface.

Conventionally, this flat type heat spreader is typically made by connecting two discrete metal plates together. Soldering process is such a method that is widely used to connect the two discrete plates together. However, the heat spreader made by this method is sometimes a little heavier than what is expected, since in the soldering process each of the metal plates is required, in view of the soldering requirements thereof, to have a minimum wall thickness which in some cases may be thicker than normally required. In addition, the reliability of the heat spreader made by the soldering process is also a problem. If the heat spreader is in fact not hermetically sealed in the soldering process, the chamber of the heat spreader will gradually lose its vacuum condition.

On the other hand, if the heat spreader is configured to have an elongated configuration, the heat spreader can be used as a heat pipe for spreading heat from one location to another remote location. For example, a first end of the heat pipe is thermally connected to a heat source while a second end of the heat pipe is thermally connected to a plurality of metal fins, thus transferring the heat generated by the heat source to the metal fins where the heat is dissipated. In this situation, the condensate resulted in the second end of the heat pipe has to travel a long distance from the second end to the first end of the heat pipe. The wick structure provided in the heat pipe is expected to provide a high capillary force and meanwhile produce a low flow resistance for the condensate so as to draw the condensate back timely. However, the wick structure provided in the conventional heat pipe generally has a uniform pore size distribution over its entire length. This uniform-type wick structure cannot satisfy this requirement. If the condensate is not timely brought back from the second end, the heat pipe will suffer dry-out problem at the first end thereof.

Therefore, it is desirable to provide a method of manufacturing a vapor chamber-based heat spreader which overcomes the foregoing disadvantages of the conventional soldering process. What is also desirable is to provide a vapor chamber-based heat spreader which can draw the condensate back effectively and timely.

SUMMARY OF INVENTION

The present invention relates, in one aspect, to a method for manufacturing a heat spreader. The method includes the following steps: (1) providing a metal foam framework, the metal foam framework having a plurality of pores and defining therein a major space; (2) filling a material into the pores and the major space of the metal foam framework and solidifying the material in the metal foam framework; (3) electrodepositing a layer of metal coating on an outer surface of the metal foam framework; (4) removing the material from the metal foam framework; and (5) filling a working fluid into the major space in the coating layer and hermetically sealing the coating layer to thereby obtain the heat spreader. The heat spreader has therein a wick structure formed of the metal foam framework and a vapor chamber formed of the major space. By this method, the heat spreader is integrally formed and therefore the reliability thereof improved. Also, the wall thickness of the heat spreader can be easily controlled by regulating the time period and the voltage associated with the electrodeposition step.

The present invention relates, in another aspect, to a heat spreader applicable for removing heat from a heat-generating component. The heat spreader includes a metal casing and a wick structure lines an inner surface of the metal casing. The metal casing defines therein a chamber and the wick structure occupies a portion of the chamber. The metal casing includes an evaporating section and a condensing section. The wick structure is in the form of a metal foam and has a pore size gradually increasing from the evaporating section towards the condensing section of the metal casing. Thus, a first section of the wick structure in conformity with the condensing section of the metal casing has a larger pore size and produces a relatively low resistance for the condensate in the condensing section. A second section of the wick structure in conformity with the evaporating section of the metal casing has a smaller pore size and is still capable of maintaining a relatively high capillary force for drawing the condensate back to the evaporating section. As a result, the flow resistance to the condensate is reduced as a whole and the condensate is thereby drawn back to the evaporating section effectively and timely.

Other advantages and novel features of the present invention will become more apparent from the following detailed description of preferred embodiments when taken in conjunction with the accompanying drawings, in which:

DETAILED DESCRIPTION

Figure 1:
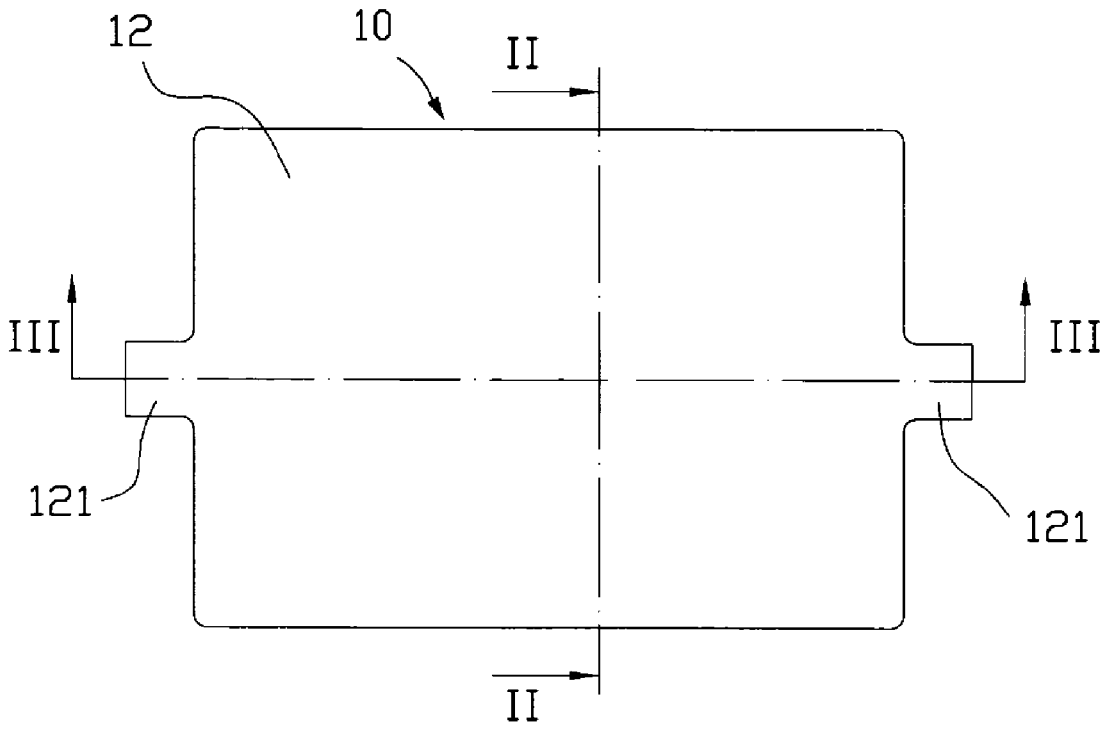
FIG. 1 is a top plan view of a heat spreader in accordance with one embodiment of the present invention.
Figure 2:
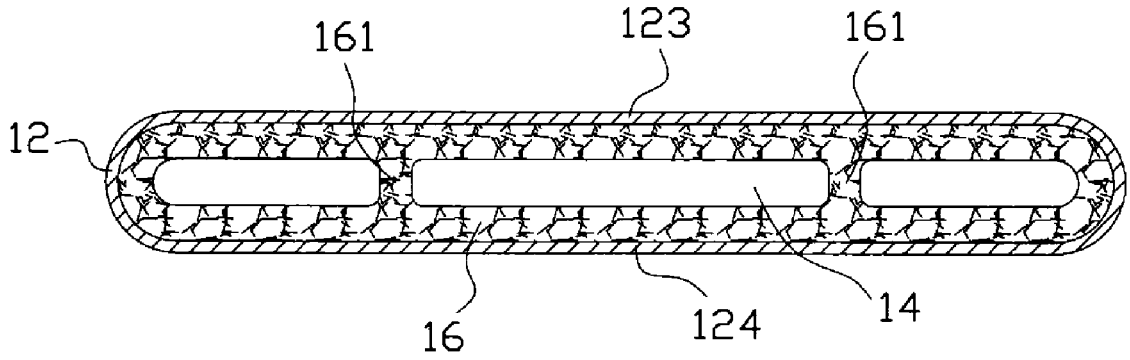
FIG. 2 is a cross-sectional view of the heat spreader of FIG. 1, taken along line II-II thereof.
Figure 3:
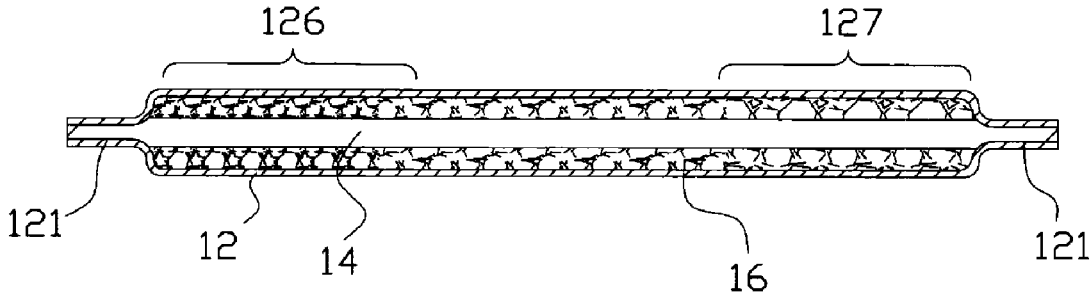
FIG. 3 is a cross-sectional view of the heat spreader of FIG. 1, taken along line III-III thereof.

FIGS. 1-3 illustrate a heat spreader 10 formed in accordance with a method of the present invention. The heat spreader 10 is integrally formed and has a flat type configuration. The heat spreader 10 includes a metal casing 12 with a chamber 14 defined therein. A wick structure 16 is arranged in the chamber 14, lining an inner surface of the metal casing 12 and occupying a portion of the chamber 14. The other portion of the chamber 14, which is not occupied by the wick structure 16 functions as a vapor-gathering region. The wick structure 16 is a porous structure and is in the form of a metal foam. The metal casing 12 is made of high thermally conductive material such as copper or aluminum. The heat spreader 10 has two open distal ends 121 extending from two opposite sides thereof, respectively. A working fluid (not shown) is injected into the chamber 14 through the two open distal ends 121 and then the heat spreader 10 is evacuated and the two distal ends 121 are hermetically sealed. The working fluid filled into the chamber 14 is saturated in the wick structure 16 and is usually selected from a liquid such as water or alcohol which has a low boiling point and is compatible with the wick structure 16.

In operation, the heat spreader 10 may function as an effective mechanism for spreading heat coming from a concentrated heat source (not shown) evenly to a large heat-dissipating surface. For example, a top wall 123 of the heat spreader 10 may be directly attached to a heat sink base (not shown) having a much larger footprint than the heat source in order to spread the heat of the heat source uniformly to the entire heat sink base. Alternatively, a plurality of metal fins may also be directly attached to the top wall 123 of the heat spreader 10. As a bottom wall 124 of the heat spreader 10 is maintained in thermal contact with the heat source, the working fluid contained in the chamber 14 of the heat spreader 10 evaporates into vapor upon receiving the heat generated by the heat source. The generated vapor enters into the vapor-gathering region of the chamber 14. Since the thermal resistance associated with the vapor spreading in the chamber 14 is negligible, the vapor then quickly moves towards the cooler top wall 123 of the heat spreader 10 through which the heat carried by the vapor is conducted to the entire heat sink base or the metal fins attached to the heat spreader 10. Thus, the heat coming from the concentrated heat source is transferred to and uniformly distributed over the large heat-dissipating surface (e.g., the heat sink base or the fins). After the vapor releases the heat, it turns into condensate. In order to bring the condensate back to the bottom wall timely, the wick structure 16 has a plurality of upright ribs 161 connecting the top and bottom walls 123, 124 of the heat spreader 10, for transporting the condensate from the top wall 123 towards the bottom wall 124 where it is again available for evaporation, as particular shown in FIG. 2. Also, these ribs 161 provide support for the heat sink attached to the heat spreader 10 and thus improve the mechanical performance of the heat spreader 10.

On the other hand, if the flat type heat spreader 10 is designed to also have an elongated configuration, the heat spreader 10 may function as a plate-type heat pipe for conveying heat from one location to another distant location. For example, if an evaporating section 126 of the elongated heat spreader 10 is thermally attached to a heat source and a cooling device such as a plurality of metal fins is thermally connected to a condensing section 127 of the heat spreader 10, then the generated vapor in the evaporating section 126 will move toward the condensing section 127 for heat dissipation and the condensate resulting from the vapor in the condensing section 127 will be brought back to the evaporating section 126 via the wick structure 16. In this situation, the condensate has to travel a long distance as it flows from the condensing section 127 to the evaporating section 126 of the heat spreader 10. In order to reduce the flow resistance to the condensate, the wick structure 16 is configured to have a pore size that gradually increases from the evaporating section 126 towards the condensing section 127, as particular shown in FIG. 3. Thus, the capillary forces and the flow resistances generated by different sections of the wick structure 16 are different. The general rule is that the larger a pore size a wick structure has, the smaller a capillary force and the lower a flow resistance it provides. Under this rule, a first section of the wick structure 16 in conformity with the condensing section 127 of the heat spreader 10 has a pore size larger than that of a second section of the wick structure 16 in conformity with the evaporating section 126 of the heat spreader 10. Thus, the first section of the wick structure 16 produces a relatively low resistance for the condensate as it flows in the condensing section 127, and the second section of the wick structure 16 is still capable of maintaining a relatively high capillary force for drawing the condensate back from the condensing section 127 to the evaporating section 126. As a result, the flow resistance to the condensate is reduced as a whole and the condensate is drawn back to the evaporating section 126 effectively and timely, thus preventing the potential dry-out problem occurring at the evaporating section 126.

Figure 4:
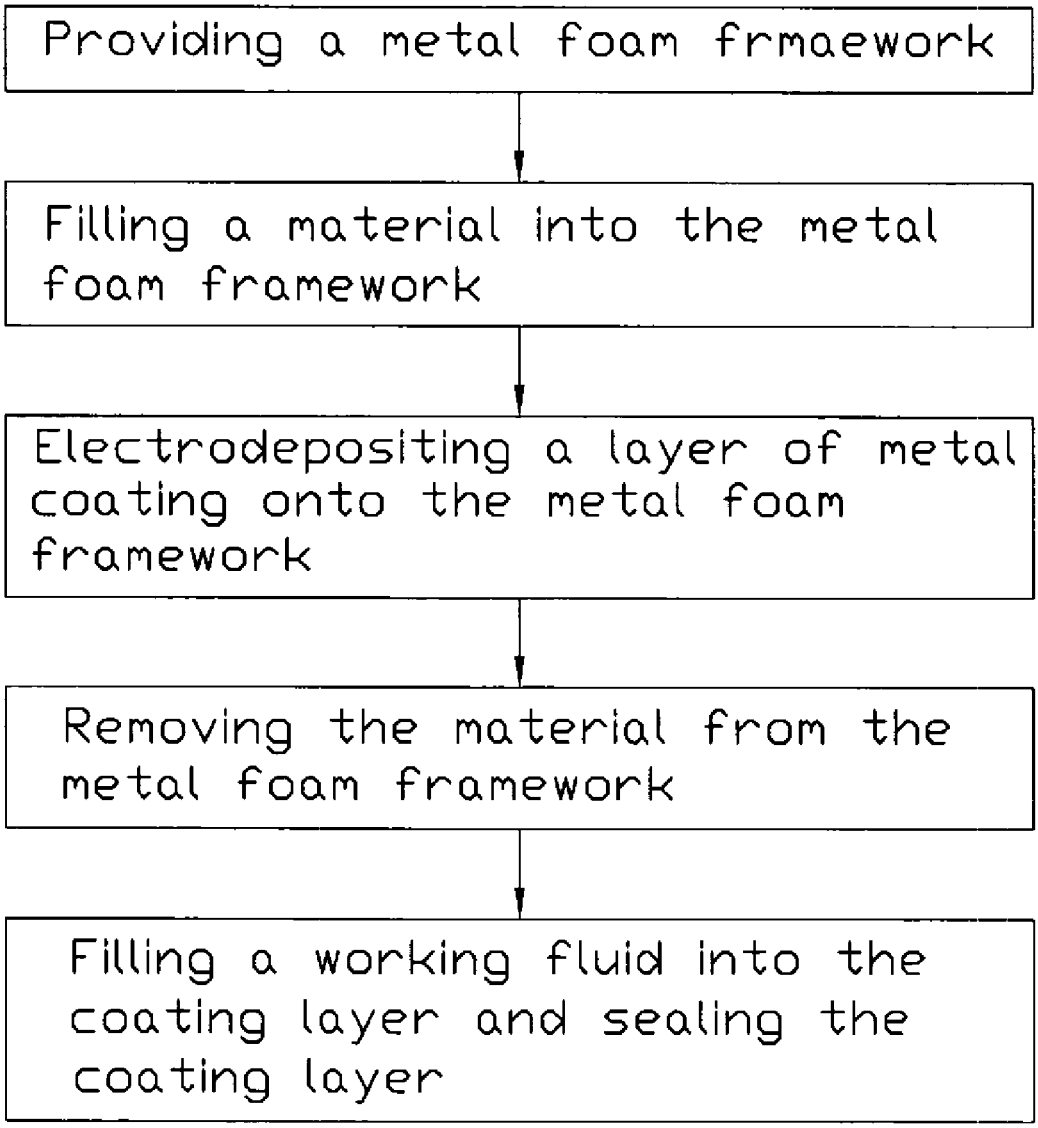
FIG. 4 is a flow chart showing a preferred method of the present invention for manufacturing the heat spreader of FIG. 1.
Figure 5:
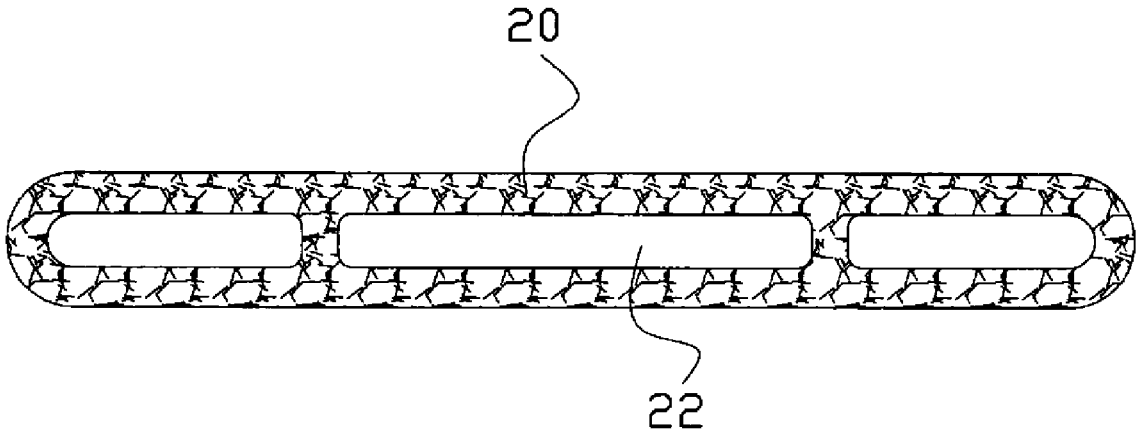
FIG. 5 is a cross-sectional view of a wick structure of the heat spreader of FIG. 1.

As shown in FIG. 4, a method is proposed to manufacture the heat spreader 10. More details about the method can be easily understood with reference to FIGS. 5-9. Firstly, a metal foam framework 20 is provided with a hollow space 22 defined therein, as shown in FIG. 5. The metal foam framework 20 is to be formed as the wick structure 16 of the heat spreader 10 and has a configuration substantially the same as that of the wick structure 16.

The metal foam framework 20 may be made of such materials as stainless steel, copper, copper alloy, aluminum alloy and silver. Typically, the metal foam framework 20 is fabricated by expanding and solidifying a pool of liquid metal saturated with an inert gas under pressure. Electroforming is also a typical method for fabricating the metal foam framework 20, which generally involves steps of providing one kind of porous material such as polyurethane foam, then electrodepositing a layer of metal over the surface of the polyurethane foam and finally heating the resulting product at a high temperature to get rid of the polyurethane foam to thereby obtain a porous metal foam. Another fabrication method for the metal foam, called die-casting process, is also widely used, which generally includes steps of providing one kind of porous material such as polyurethane foam, filling ceramic slurry into the pores of the porous polyurethane foam and then solidifying the ceramic slurry therein, then heating the resulting product at a high temperature to get rid of the polyurethane foam to obtain a matrix of porous ceramic, then filling metal slurry into the pores of the ceramic matrix and finally, getting rid of the ceramic material after solidification of the metal slurry to thereby obtain a porous metal foam. In addition, there are still some other methods suitable for fabrication of metal foam. Fox example, the metal foam can be made by steps of filling a kind of bubble-generating material such as metallic hydride into a metal slurry to generate a large number of bubbles distributing randomly throughout the metal slurry and then solidifying the metal slurry to thereby obtain a metal foam with a plurality of pores therein. The size of the pores of the metal foam framework 20 may be in a wide range, subject to the levels of pressure applied during the fabrication process. If different pressures are applied to different sections of the metal foam framework 20 during the fabrication process, then a metal foam with different pore sizes will be obtained. In the present invention, the pressure is gradually increased along a direction from one end of the metal foam framework 20 toward an opposite end thereof; thus, the pore size is gradually decreased along the direction. Referring to FIG. 3, the wick structure 16 formed by the metal foam framework 20 has a pore size gradually decreased from the end neighboring the condensing section 127 towards the end neighboring the evaporating section 126.

Figure 6:
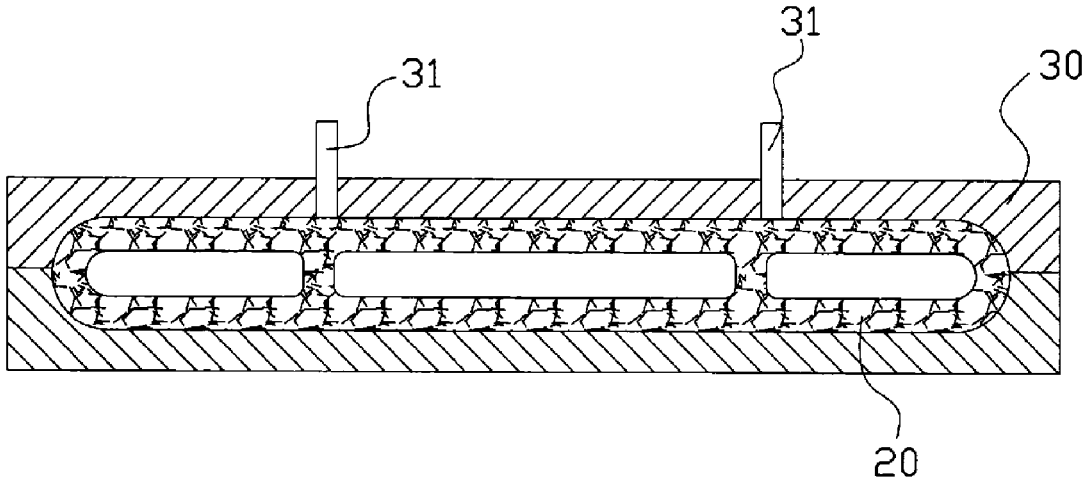
FIG. 6 is a schematic, cross-sectional view of a device applied for filling a filling material into the wick structure of FIG. 5.
Figure 7:
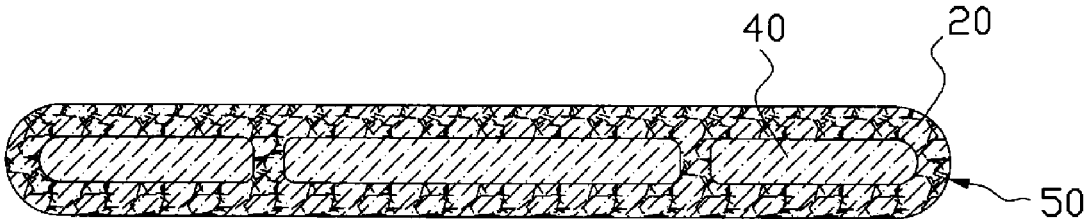
FIG. 7 is a cross-sectional view of the wick structure of FIG. 5 after being filled with the filling material.

Then, a mold 30 with a cavity therein is provided and the metal foam framework 20 is fittingly placed and received in the cavity of the mold 30, as shown in FIG. 6. The cavity of the mold 30 has a configuration substantially the same as that of the chamber 14 of the heat spreader 10 to be formed. A filling material 40 then is filled into the mold 30 via filling tubes 31 connecting to the cavity of the mold 30. The filling material 40 is selected from such materials that can be easily removed after the heat spreader 10 is formed. For example, the filling material 40 may be paraffin or some kind of plastic or polymeric material that is liquefied when heated. The filling material 40 is filled into the mold 30 when it is at a molten state. The filling material 40 solidifies in the mold 30 when it is cooled. After the filling material 40 in the mold 30 is solidified, the mold 30 is removed. As a result, the pores in the metal foam framework 20 and the space 22 defined by the metal foam framework 20 are filled with the filling material 40, as shown in FIG. 7.

Figure 8:
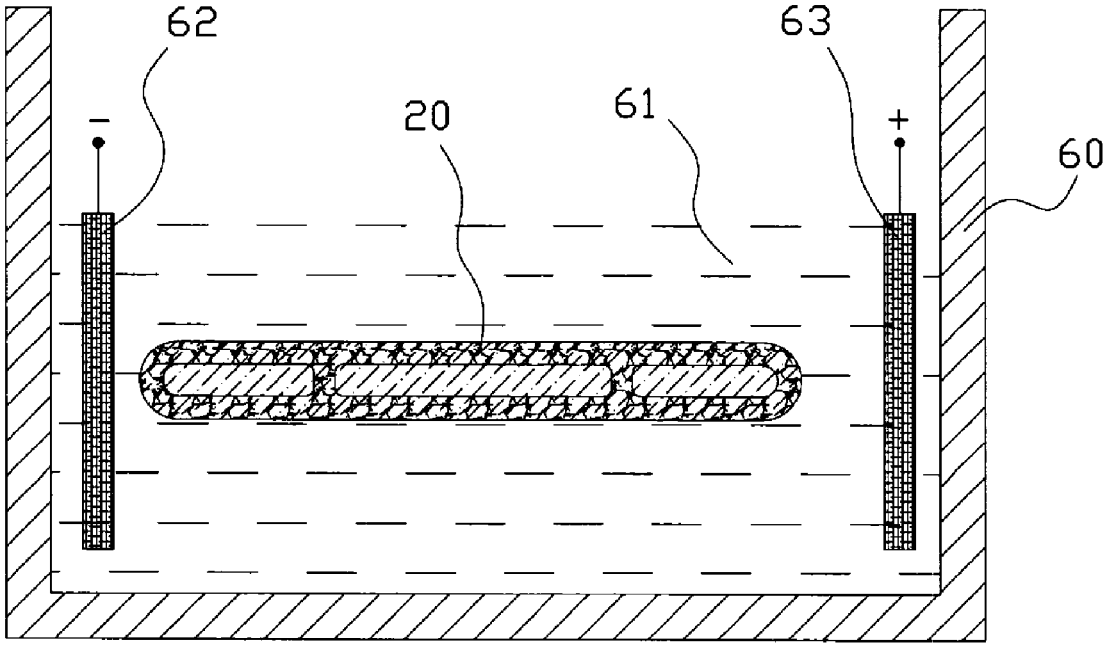
FIG. 8 is a schematic, cross-sectional view of an electrodeposition bath for electrodepositing a layer of metal coating on an outer surface of the wick structure of FIG. 7.
Figure 9:
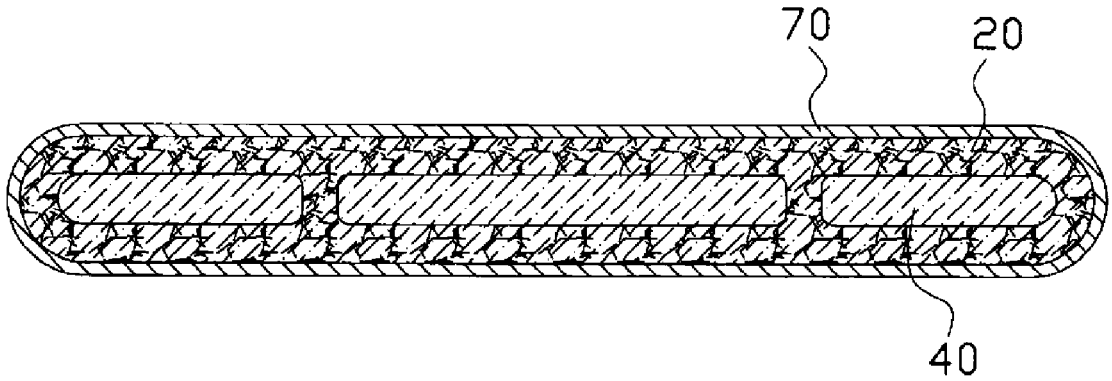
FIG. 9 is a view similar to FIG. 7, but an outer surface of the wick structure is electrodeposited with the layer of metal coating.

Thereafter, the method, as shown in FIG. 4, includes an electrodeposition step in order to form the metal casing 12 of the heat spreader 10. In order to proceed with the electrodeposition, an electrically conductive layer 50 is coated on an outer surface of the metal foam framework 20 filled with the filling material 40, whereby the outer surface of the metal foam framework 20 is conductive. Then, the metal foam framework 20 with the filling material 40 contained therein is disposed into an electrodeposition bath 60 which contains an electrolyte 61, as shown in FIG. 8. The electrodeposition bath 60 includes a cathode electrode 62 and an anode electrode 63, both of which are immersed in the electrolyte 61 and are located at opposite sides of the metal foam framework 20, respectively. After electrodepositing for a specific period of time, the metal foam framework 20 is taken out of the electrodeposition bath 60 and a layer of metal coating 70 is accordingly formed on the outer surface of the metal foam framework 20, as shown in FIG. 9. Then, the filling material 40 in the metal foam framework 20 is removed away from the coating layer 70 by heating the filing material 40 at a temperature above a melting temperature of the filing material 40. Although it is not shown in FIG. 9, it should be recognized that two open ends as illustrated in FIGS. 1 and 3 are also formed by the coating layer 70 after the electrodeposition step so that the filling material 40 is able to be discharged from the metal foam framework 20 and the coating layer 70. After the filling material 40 is completely removed, the wick structure 16, the casing 12 and the heat spreader 10 as shown in FIGS. 1-3 are obtained. Thereafter, the working fluid is injected into the casing 12 to be saturated in the wick structure 16. Finally, the casing 12 is vacuumed and the two open ends are sealed.

According to the method, the wall thickness of the heat spreader 10 can be easily controlled by regulating the time period and voltage involved in the electrodeposition step. Compared with the conventional soldering method, the reliability of the heat spreader 10 made by the method is also improved since the heat spreader 10 is integrally formed.

Figure 10:
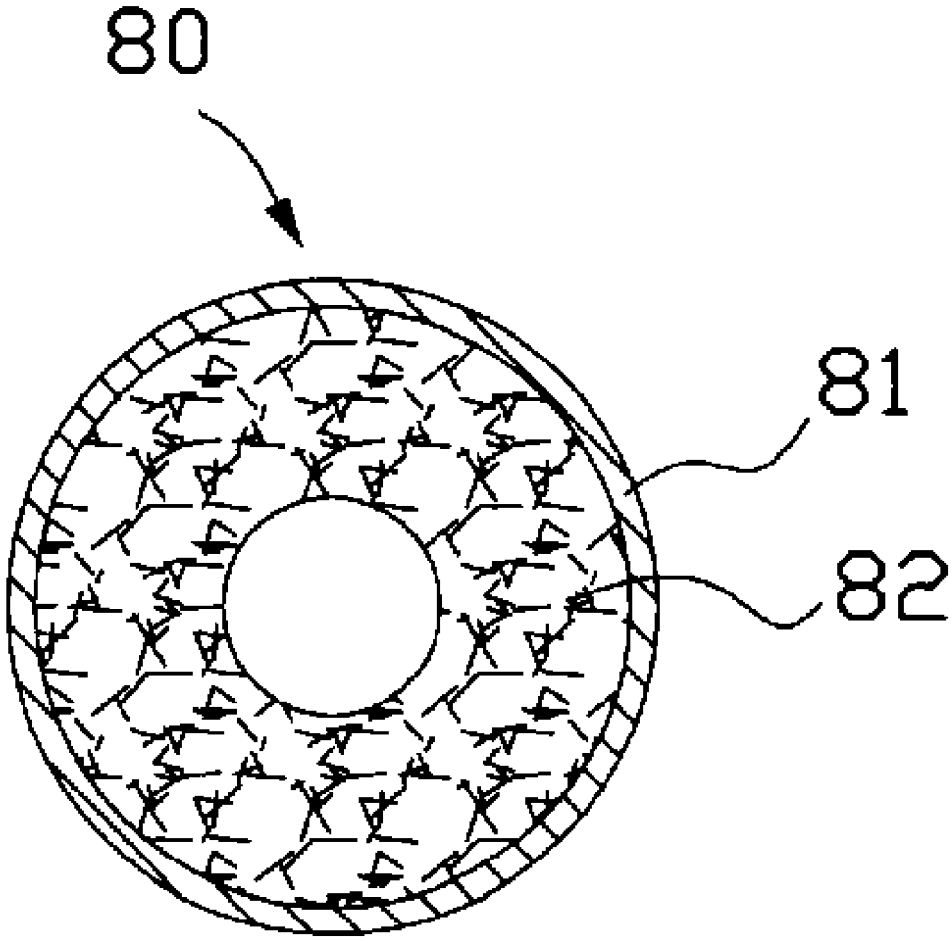
FIG. 10 is a radial cross-sectional view of a heat spreader in accordance with an alternative embodiment of the present invention.
Figure 11:
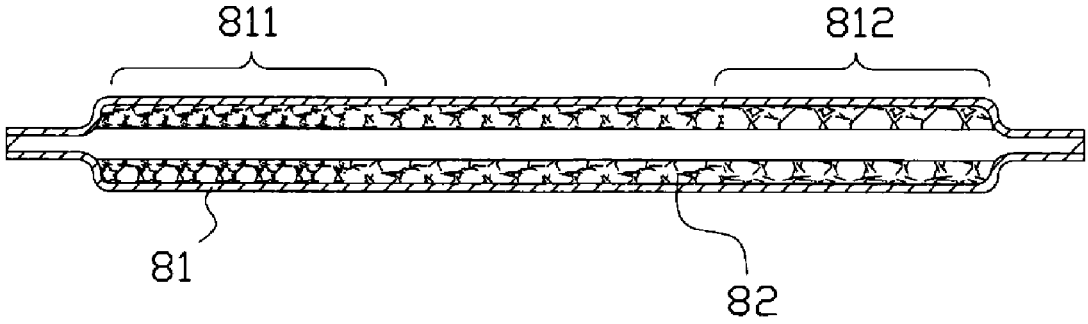
FIG. 11 is a longitudinal cross-sectional view of the heat spreader of FIG. 10.

FIGS. 10-11 show a heat spreader 80 in accordance with an alternative embodiment of the present invention. The heat spreader 80 is elongated and is in the form of a round heat pipe. Similarly, the heat spreader 80 may be made by the foregoing method as shown in FIG. 4. The heat spreader 80 includes an elongated metal casing 81 and a wick structure 82 lining an inner surface of the metal casing 81. The wick structure 82 is in the form of a metal foam and has a pore size gradually increased from an evaporating section 811 towards a condensing section 812 of the heat spreader 80.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for manufacturing a heat spreader comprising the steps of:

providing a metal foam framework, the metal foam framework having a plurality of pores and defining therein a major space;

filling a material into the pores and the major space of the metal foam framework and solidifying the material in the metal foam framework;

electrodepositing a layer of metal coating on an outer surface of the metal foam framework;

removing the material from the metal foam framework; and filling a working fluid into said metal foam framework in the coating layer and hermetically sealing the coating layer to thereby obtain the heat spreader with therein a wick structure formed by the metal foam framework and a vapor chamber formed by said major space.

2. The method of claim 1, wherein the material is filled into the pores and the major space of the metal foam framework in a molten state and the material is one of paraffin, plastic and polymeric material.

3. The method of claim 1, wherein the material is removed from the metal foam framework by heating the coating layer and the material above the melting temperature of the material.

4. The method of claim 1, wherein the metal foam framework has a rib in the major space thereof.

5. The method of claim 1, further comprising a step of coating an electrically conductive layer on the outer surface of the metal foam framework before the electrodeposition step.

6. The method of claim 1, wherein the metal foam framework is fabricated by one of a die casting method and an electroforming method.

7. The method of claim 1, wherein the metal foam framework is configured to have a pore size gradually decreased in a direction thereof.

* * * * *

UNITED STATES PATENT AND TRADEMARK OFFICE

CERTIFICATE OF CORRECTION

PATENT NO. : 7,651,601 B2
APPLICATION NO. : 11/306699
DATED : January 26, 2010
INVENTOR(S) : Hwang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1054 days.

Signed and Sealed this

Twenty-third Day of November, 2010

David J. Kappos

David J. Kappos
*Director of the United States Patent and Trademark Office*